US008448592B2

(12) United States Patent
Crowell et al.

(10) Patent No.: US 8,448,592 B2
(45) Date of Patent: May 28, 2013

(54) EXTERNAL RESCUE AND RECOVERY DEVICES AND METHODS FOR UNDERWATER VEHICLES

(75) Inventors: Jonathan C. Crowell, Dorchester, MA (US); David Charles, Franklin, MA (US)

(73) Assignee: Ocean Server Technology, Inc., Fall River, MA (US)

( * ) Notice: Subject to any disclaimer, the term of this patent is extended or adjusted under 35 U.S.C. 154(b) by 518 days.

(21) Appl. No.: 12/259,570

(22) Filed: Oct. 28, 2008

(65) Prior Publication Data

US 2009/0107388 A1 Apr. 30, 2009

Related U.S. Application Data

(60) Provisional application No. 60/983,784, filed on Oct. 30, 2007.

(51) Int. Cl.

| | |
|---|---|
| ***B63B 45/04*** | (2006.01) |
| ***B63C 7/26*** | (2006.01) |
| ***B63G 8/24*** | (2006.01) |
| ***B63G 8/42*** | (2006.01) |
| ***B60Q 1/52*** | (2006.01) |

(52) U.S. Cl.
USPC ..... 114/322; 114/326; 114/329; 114/330; 114/336; 116/26; 116/209

(58) Field of Classification Search
USPC ..... 114/316–336, 312, 20.1–25; 116/209, 116/210, 26, 27
See application file for complete search history.

(56) References Cited

U.S. PATENT DOCUMENTS

| | | | | |
|---|---|---|---|---|
| 2,825,803 | A * | 3/1958 | Newbrough | 455/96 |
| 3,341,871 | A * | 9/1967 | Oliveau | 441/10 |
| 3,609,825 | A | 10/1971 | Pullos | |
| 3,616,775 | A | 11/1971 | Holter | |
| 3,665,884 | A | 5/1972 | Gustafson | |
| 3,906,370 | A * | 9/1975 | Apps | 455/96 |
| 3,945,338 | A * | 3/1976 | Correa | 116/210 |
| 3,961,589 | A | 6/1976 | Lombardi | |

(Continued)

FOREIGN PATENT DOCUMENTS

| | | |
|---|---|---|
| EP | 0 937 639 | 8/1999 |
| JP | 2001 138806 | 5/2001 |

(Continued)

OTHER PUBLICATIONS

European Search Report from EP 08075856.8, mailed Apr. 20, 2011.

*Primary Examiner* — Ajay Vasudeva
(74) *Attorney, Agent, or Firm* — Nutter McClennen & Fish LLP

(57) ABSTRACT

Methods and devices are provided for rescuing and recovering underwater vehicles. In one embodiment, a system is provided that includes a modular rescue device configured to attach to an underwater vehicle, such as with a tow line. The rescue device can include one or more emergency mechanisms that can be automatically and/or manually activated to aid in detecting the location of the underwater vehicle in the event of an emergency. One exemplary emergency mechanism includes a buoyancy mechanism, e.g., an expandable lift bag, configured to be inflated with a fluid to add buoyancy force to the system to pull the underwater vehicle toward a water surface. Another exemplary emergency mechanism includes a signaling mechanism configured to signal the underwater vehicle's location.

12 Claims, 3 Drawing Sheets

U.S. PATENT DOCUMENTS

| | | | | |
|---|---|---|---|---|
| 4,055,138 | A | | 10/1977 | Klein |
| 4,271,552 | A | | 6/1981 | Sandler |
| 4,433,638 | A | * | 2/1984 | Ashline ..... 116/210 |
| 4,482,333 | A | | 11/1984 | Gen |
| 4,887,541 | A | | 12/1989 | Rodeman |
| 5,348,501 | A | | 9/1994 | Brown |
| 6,021,731 | A | | 2/2000 | French et al. |
| 6,383,045 | B1 | | 5/2002 | Eckardt |
| 6,657,585 | B1 | | 12/2003 | Kucik |
| 6,739,924 | B1 | | 5/2004 | Groen et al. |
| 7,054,230 | B1 | | 5/2006 | Nelson |
| 2005/0190059 | A1 | | 9/2005 | Wehrenberg |

FOREIGN PATENT DOCUMENTS

| | | | |
|---|---|---|---|
| JP | 2002314439 | A * | 10/2002 |
| WO | WO 98/45169 | | 10/1998 |
| WO | WO 2004/014724 | | 2/2004 |

* cited by examiner

EXTERNAL RESCUE AND RECOVERY DEVICES AND METHODS FOR UNDERWATER VEHICLES

CROSS REFERENCE TO RELATED APPLICATIONS

The present application claims the priority of U.S. Provisional Application Ser. No. 60/983,784 filed Oct. 30, 2007 entitled "External Rescue And Recovery Device For Underwater Vehicles," which is hereby incorporated by reference in its entirety.

BACKGROUND OF THE INVENTION

Autonomous Underwater Vehicles ("AUV") and other devices that drive underwater are generally required to be very close to neutrally buoyant for proper underwater operation. As such, a vehicle that weighs about 42 pounds in air weighs about negative 7 ounces in water if the buoyancy is +1%. When operating an AUV there is a real fear that the AUV could become stuck underwater in mud or caught on a rope or line, and with so little upward force it is not likely that the AUV would be able to force itself back to the water surface for recovery.

If an AUV drives into mud nose first, it might take significant upward force (buoyancy) to pull the AUV free and send it to the water surface. This could require about 2-10 pounds of upward force to have the AUV pulled free from the mud. The normal operating model is to send divers down to free the AUV and let it float to the water surface. One method of creating extra buoyancy is to carry one or more ballast weights, e.g., lead weights, at neutral buoyancy, then drop a weight using an automatic release to increase the AUV's buoyancy. Emergency ballast weights have been used on many underwater vehicles, but such weights typically provide only a few extra pounds of buoyancy, or a few percent of the body weight.

Underwater devices such as AUVs present difficulties that prevent or restrict the adding of safety devices to the body of the vehicle. For example, their hulls or internal structures are usually pressure vessels to keep electronics contained therein dry while underwater at some pressure, thereby making access through the hull for installation or deployment problematic. Space within the underwater vehicle is very limited to add safety devices, but many underwater vehicles add some form of emergency device. The implementation of the emergency device is usually tightly integrated into the design of the underwater vehicle, burdening the underwater vehicle with the emergency device's cost and complexity. Conventional emergency devices include 1) a drop or ballast weight that can be dropped from the underwater vehicle automatically if it detects an emergency situation to add many pounds of upward force (buoyancy) to help the vehicle free itself and get to the surface for recovery; 2) an inflatable bag filled with a gas providing large amounts of positive (upward) buoyancy aiding the vehicle to get to the surface of the water, such as the expandable bag or sleeve described in U.S. Pat. No. 4,271,552 issued Jun. 9, 1981 titled "Torpedo Floatation Device," hereby incorporated by reference in its entirety, but the complexity of inflatable bags dominates the underwater vehicle design, so they are not generally used; 3) an acoustic locator pinger that sends a loud sound out at a particular frequency or rate so the vehicle can be located from the surface with directional location devices; 4) a small float, optionally with a Global Positioning System ("GPS") to transmit the location of the vehicle in distress via radio signals, dropped on a long line that is released, floats to the surface, and is used to find the underwater vehicle so it can be pulled up or retrieved by dive; and 5) lights to aid divers in close range location of the distressed vehicle. While certain of these conventional emergency devices have been used on underwater vehicles, they are either ineffective and/or have been integrated into the main vehicle, adding significantly to the size, complexity, and cost of the main vehicle. Furthermore, these systems need to be planned in the early stages of a design of the underwater vehicle.

Accordingly, there remains a need for effective, efficient rescue and recovery of underwater vehicles.

SUMMARY OF THE INVENTION

The present invention generally provides methods and devices for rescuing and recovering underwater vehicles. In one embodiment, a rescue and recovery system is provided that includes a submersible housing configured to be coupled to and disposed at least partially outside an underwater vehicle, an emergency mechanism located within the housing and configured to be deployed upon detection of an emergency condition, and an actuator configured to deploy the emergency notification mechanism. The emergency condition can vary, but it can include at least one of exceeding a threshold dive depth, exceeding a threshold dive time, falling below a threshold travel speed, the housing longitudinally oriented above a threshold angle, a power loss in the underwater vehicle coupled to the housing, exceeding a threshold dive speed, and receipt of a distress signal. The emergency mechanism can have a variety of configurations and can include at least one of a light, an expandable bag, a flare, a signal transmitter, a flag, a dye, and a GPS system. In some embodiments, the emergency mechanism can include a buoyancy mechanism, and the actuator can be configured to expand the buoyancy mechanism to increase a buoyancy of the housing and the underwater vehicle coupled to the housing.

The rescue and recovery system can have any number of variations. For example, the housing can be configured to decouple from the underwater vehicle upon detection of an emergency condition. As another example, the actuator can include at least one of an R134a refrigerant, carbon dioxide, and an explosive powder. As yet another example, the rescue and recovery system can include a sensor configured to detect an emergency condition and to trigger the actuator to deploy the emergency mechanism upon detection of the emergency condition. The sensor can be located within the housing. In some embodiments, the housing can be coupled to an underwater vehicle, and the sensor can be located within the underwater vehicle. As still another example, the rescue and recovery system can include a power system located within the housing and be configured to provide power to the housing independent of an underwater vehicle coupled to the housing. The actuator can be configured to turn on the power system upon detection of the emergency condition.

In some embodiments, the rescue and recovery system can include a cable configured to couple the housing to the underwater vehicle. The cable can connect to a head of the housing and a tail of the underwater vehicle to allow the housing to be towed underwater by the underwater vehicle. The cable can be configured to have a first length extend between the housing and the underwater vehicle and a second length that is longer than the first length contained within at least one of the housing and the underwater vehicle. At least a portion of the cable can be configured to unspool when underwater to increase a distance between the housing and the underwater vehicle.

In another embodiment, a self contained rescue system for an underwater vehicle is provided that includes an expandable buoyancy mechanism, a propellant providing system operatively connected to the expandable buoyancy mechanism for selectively inflating the buoyancy mechanism, and a mechanical connecting element for connecting the rescue system to an underwater vehicle. The system can have any number of variations. For example, the buoyancy mechanism can include an inflatable bag. As another example, the system can include a localization means and a communication means for determining, following deployment of the buoyancy mechanism and arrival at a water surface, a location of the rescue system and communicating the location. As yet another example, the system can include an acoustic pinger for communicating in water.

Some embodiments can include an underwater vehicle, and the mechanical connecting element can be connected to the underwater vehicle. The rescue system and the underwater vehicle can be configured to be in electronic communication. In some embodiments, the underwater vehicle can be configured to provide power to the rescue system. The underwater vehicle can be configured to signal the rescue system to deploy the buoyancy mechanism. The underwater vehicle can include an emergency detection means configured to signal the rescue system to deploy the buoyancy mechanism. The rescue system can be configured to be towed behind the underwater vehicle, e.g., about 2 to 4 feet behind the underwater vehicle.

In another embodiment, a rescue and recovery system is provided that includes a housing, a buoyancy chamber included in the housing and having a buoyancy mechanism disposed therein, a propellant chamber included in the housing, operatively connected to the buoyancy chamber, and configured to trigger expansion of the buoyancy mechanism disposed in the buoyancy chamber, and a coupling element configured to couple the housing to an underwater vehicle. The system can have any number of variations. For example, the coupling element can include a cable, and the cable can be configured to be removably coupled to the underwater vehicle. As another example, expansion of the buoyancy mechanism can be effective to float at least the housing toward a water surface. The system can include a localization means and a communication means for determining, following deployment of the buoyancy mechanism and arrival at the water surface, a location of the housing and communicating the location.

BRIEF DESCRIPTION OF THE DRAWINGS

The invention will be more fully understood from the following detailed description taken in conjunction with the accompanying drawings, in which.

DETAILED DESCRIPTION

Various exemplary methods and devices are provided for rescuing and recovering underwater vehicles. A person skilled in the art will appreciate that an "underwater vehicle" can include an unmanned, untethered underwater vehicle such as an Unmanned Undersea Vehicle ("UUV") and an Autonomous Underwater Vehicle ("AUV"), and an unmanned, tethered underwater vehicle such as a Remotely Operated Underwater Vehicle ("ROV"). In one embodiment, a system is provided that includes a modular rescue device configured to attach to an underwater vehicle. The "rescue device" discussed herein can also be referred to in various embodiments as a "rescue buoy," a "rescue vessel," and an "emergency tow float." The rescue device can include a tow vessel smaller in size than the underwater vehicle that can be attached to the underwater vehicle in a short amount of time and can be pulled or towed underwater by the underwater vehicle without significantly changing the underwater vehicle's operating characteristics. The rescue device can include one or more emergency mechanisms that can be automatically and/or manually activated to aid in detecting the location of the underwater vehicle in the event of an emergency, such as the underwater vehicle losing power, getting stuck or trapped in mud, rope, or other obstacle, performing outside safe operating limits, etc. One exemplary emergency mechanism includes a buoyancy mechanism, e.g., an expandable lift bag, configured to be inflated with a fluid to add buoyancy force to the system including the rescue device and underwater vehicle to pull the underwater vehicle toward a water surface. The rescue device can be configured to autonomously detect an emergency situation and deploy one or more of its emergency mechanisms, and/or the rescue device can be configured to listen for a trigger signal such as a signal from its attached underwater vehicle or a coded acoustic signal that can be sent from a distance, e.g., from above a water surface hundreds of feet away, and that can remotely signal the rescue device to deploy one or more of its emergency mechanisms.

Figure 1:
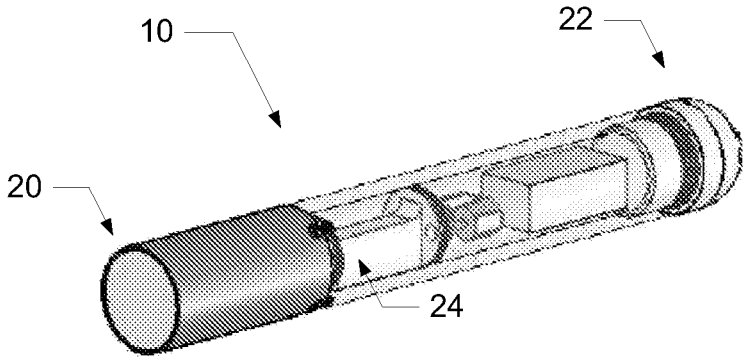
FIG. 1 is a perspective view of one embodiment of a rescue device.
Figure 2:
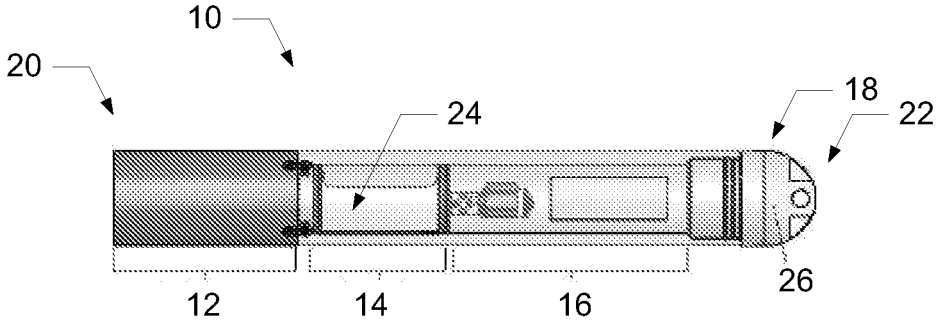
FIG. 2 is a side view of the rescue device of FIG. 1.

FIGS. 1 and 2 illustrate one exemplary embodiment of a rescue device 10 that can be submersed under water, can be attached to an underwater vehicle, and can include one or more emergency mechanisms configured to help locate the underwater vehicle during use of the underwater vehicle. The device 10 can have a variety of shapes, sizes, and configurations. As illustrated, the device 10 includes an elongate body or housing including an emergency mechanism containment chamber 12, a propellant chamber 14, an electronics chamber 16, and a nose portion 18. Each of the chambers 12, 14, 16 and the nose portion 18 can have any size and shape and can be located anywhere in the device 10. As illustrated, the chambers 12, 14, 16 and the nose portion 18 are longitudinally arranged along the device 10 with the containment chamber 12 at a terminal, tail end 20 of the device 10, the nose portion 18 at a terminal, head end 22 of the device 10, the propellant chamber 14 adjacent the containment chamber 12, and the electronics chamber 16 disposed between the propellant chamber 14 and the nose portion 18. The propellant and electronics chambers 14, 16 are preferably integrally formed together in a single housing with the containment chamber 12 removably coupled thereto, e.g., using a plurality of screws and/or other attachment mechanism. The nose portion 18 can be integrally formed with its adjacent chamber, the electronics chamber 16, or, as illustrated, the nose portion 18 can be an independent, pressure tight element attached to the remainder of the device 10 using, e.g., a magnetic hall effect switch. The housing of the device 10 is shown as being at least partially transparent, specifically in the propellant and electronics chambers 14, 16, but any portion of the housing, including the entire housing, can be opaque. The device 10 can have a substantially cylindrical shape having a substantially constant circular cross-sectional shape along a longitudinal length thereof as shown, although the device 10 can have any shape. The head end 22 of the device 10, e.g., the nose portion 18, can taper distally, e.g., be rounded (as shown), cone-shaped, truncated cone-shaped, etc., to help improve hydrodynamics of the device 10.

The containment chamber 12 can be configured to include one or more emergency mechanisms disposed therein that can, as mentioned above, be used to help determine a location of the device 10 and hence also an underwater vehicle attached to the device 10. The emergency mechanism(s) in the containment chamber 12 can be effective above a water surface, but as will be appreciated by a person skilled in the art, they can be particularly effective when the device 10 and the underwater device are submerged and at a location remote from a manned control center. While the device's emergency mechanisms are preferably contained within the containment chamber 12 to help protect them from the outside environment and from other components of the device 10, one or more emergency mechanisms can be located only partially within the containment chamber 12 or not be located within the containment chamber 12 at all, e.g., be in another chamber 14, 16, be coupled to an outside surface of the device 10, etc.

The containment chamber 12 can include any one or more emergency mechanisms in any combination. The emergency mechanisms discussed herein are non-limiting examples only, and a person skilled in the art will appreciate that these and/or other emergency mechanisms can be disposed in the containment chamber 12 and/or disposed elsewhere within or on the device 10. Generally, the containment chamber 12 can be associated with physical or mechanical emergency mechanisms, while the electronics chamber 16 can be associated with electronic emergency mechanisms, although any type of emergency mechanism can be located anywhere.

One embodiment of a physical or mechanical emergency mechanism includes a buoyancy mechanism such as a lift bag, a balloon, or other expandable member that can be contained in an unexpanded or non-deployed position at least partially inside the containment chamber 12 and that can be inflated with a fluid or otherwise expanded to increase a buoyancy of the device 10. Generally, underwater devices can be neutrally buoyant, making them prone to becoming easily trapped or stuck underwater as they have very little upward force due to buoyancy. The device 10 attached to a neutrally buoyant underwater vehicle can also be neutrally buoyant and hydrodynamic, but it can be configured to increase its buoyancy upon deployment of the buoyancy mechanism. The buoyancy mechanism can have any size, shape, and configuration, and can be configured to provide any amount of buoyancy force when in an expanded or deployed position, e.g., at least about fourteen pounds of upward force, although the buoyancy force provided by an expanded buoyancy mechanism is preferably at least enough to pull the device 10 alone and/or the device 10 with an underwater vehicle attached thereto from underwater to the water surface. Increasing a buoyancy of the device 10 and an underwater vehicle attached thereto by at least about three orders of magnitude can provide sufficient upward force to float the device 10 and the underwater vehicle, e.g., at least about fourteen pounds of buoyancy can provide about 33% reserve buoyancy to an underwater vehicle weighing about forty-two pounds, which can be sufficient buoyancy to float the underwater vehicle. The buoyancy mechanism can be brightly colored, e.g., fluorescent, safety orange, etc., and/or have reflective properties to help improve visibility of the buoyancy mechanism from a distance.

Another embodiment of a physical or mechanical emergency mechanism includes a relatively long line that can be released or unspooled to allow the rescue device 10 to separate from its associated underwater vehicle if the device 10 detects or is notified that the underwater vehicle is not being pulled free after the buoyancy mechanism has been deployed. Similar to unwinding a fishing rod with a bobber attached, the long line can allow the device 10 to float to the water surface while still attached to the distressed underwater vehicle stuck underwater, thereby marking the location of the underwater vehicle. Other embodiments of physical or mechanical emergency mechanisms include flares (smoke and/or light), flags (which can be brightly colored), flashing lights located on and/or visible through the housing, and dyes configured to color water to make a large, brightly colored target for aircraft to locate.

The propellant chamber 14 can be configured to have a deployment mechanism disposed therein that is configured as an actuator to deploy at least one emergency mechanism. The deployment mechanism can have a variety of configurations, but in the illustrated exemplary embodiment the deployment mechanism includes at least one propellant contained within at least one propellant container 24 within the propellant chamber 14. The propellant container 24 can be in selective fluid communication with the containment chamber 12 such that at least a portion of the propellant disposed in the propellant chamber 14 can be introduced into the containment chamber 12 to deploy at least one emergency mechanism disposed therein. Any fluid or solid propellant can be used, e.g., a gas such as carbon dioxide, a refrigerant such as R134a (tetrafluoroethane), and an explosive powder. R134a has a much lower vapor pressure compared to carbon dioxide and can thus be particularly effective in relatively shallow water (up to about 200 feet), while carbon dioxide can be particularly effective in deep water (up to about 2000 feet). Explosive powder can be particularly effective at very deep depths (over about 2000 feet). The propellant chamber 14 preferably has one propellant loaded therein, but the propellant chamber 14 can be configured to contain a plurality of propellants that can be selectively deployed at different depths depending on the propellant's effectiveness at the depth of the device 10 when an emergency mechanism is deployed.

Figure 3:
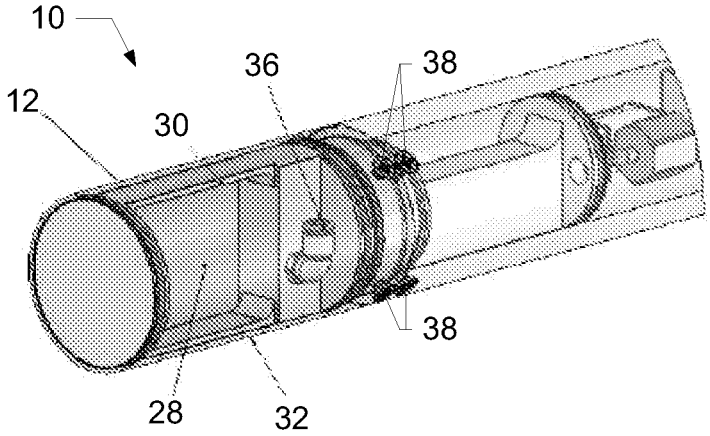
FIG. 3 is a perspective view of a tail portion of the rescue device of FIG. 1 having a containment chamber in an undeployed state.
Figure 4:
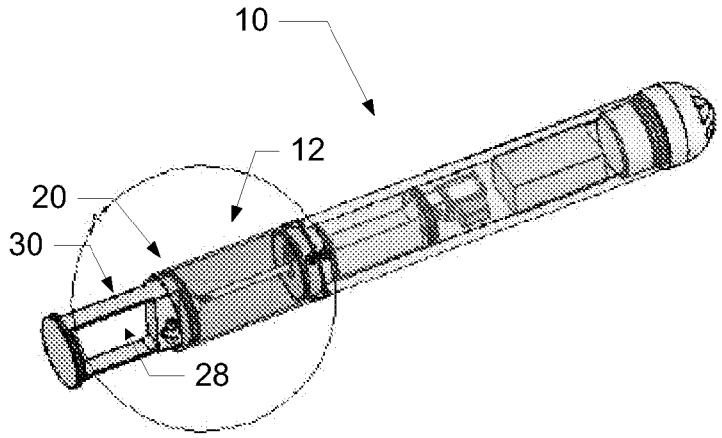
FIG. 4 is a perspective view of the rescue device including the containment chamber of FIG. 3 in an deployed state.
Figure 5:
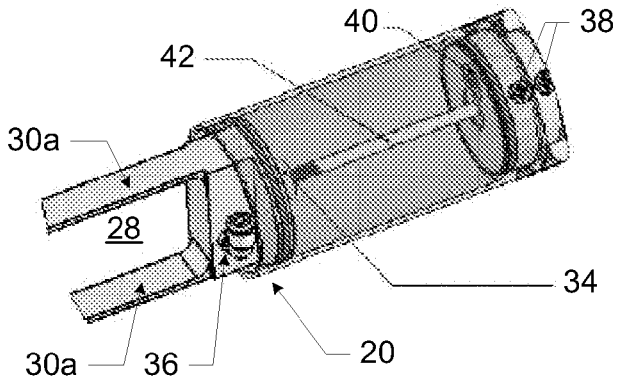
FIG. 5 is a close-up perspective view of the containment chamber of FIG. 4.

FIGS. 3-5 illustrate one embodiment of the containment chamber 12 configured to receive an inflatable bag in an opening 28 formed in the containment chamber 12, with the propellant chamber 14 configured to deploy the bag from the containment chamber 12. The containment chamber 12 can have a variety of configurations, but as shown, the containment chamber 12 includes a cylindrical housing 32 configured to have disposed therein a piston assembly 30 having opposed arms **30*a* that define the opening 28. To arm the device 10 with the bag disposed in the opening 28, the containment chamber 12 can be moved from an undeployed position, shown in FIG. 3, to a deployed position, shown in FIGS. 4 and 5, by ejecting the piston assembly 30 from the cylindrical housing 32 to provide better access to an interior of the containment chamber 12. The piston assembly 30 can be manually and/or electronically ejected from the cylindrical housing 32 in any way, as will be appreciated by a person skilled in the art, such as by unscrewing screws 38 attaching the containment chamber 12 via a release plug 34 to the propellant chamber 14. Ejecting the piston assembly 30 can proximally move the piston assembly 30 to extend beyond the tail end 20 of the device 10 to expose a tube fitting 36. The piston assembly 30 can remain coupled to the containment chamber 12 in its deployed position by being coupled to the release plug 34, which can be coupled to a coupling mechanism such as an expandable rod 42 or a spring configured to extend between the release plug 34 and a distal portion of the cylindrical housing 32**.

Figure 6:
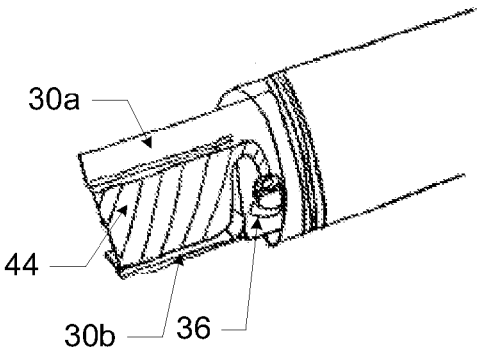
FIG. 6 is a perspective view of the containment chamber of FIG. 5 with an inflatable bag disposed therein in an undeployed position.

The bag can be coupled with the tube fitting 36 by, e.g., inserting a fill tube of the bag within the tube fitting 36 of the piston assembly 30 and positioning the bag within the opening 28 between the opposed arms 30*a* of the piston assembly 30. The bag is preferably tightly wound or otherwise compressed into a fully unexpanded configuration before the bag is coupled to the containment chamber 12, which can help reduce a volume of the bag disposed in the containment chamber 12. As will be appreciated by a person skilled in the art, the tube fitting 36 and the fill tube can be secured together using a locking mechanism, e.g., corresponding threads on the tube fitting 36 and the fill tube, a latch, etc., to help keep the bag connected to the device 10 when the bag is deployed. FIG. 6 illustrates an exemplary embodiment of an inflatable bag 44 connected to the tube fitting 36 and disposed in the opening 28 in an undeployed position.

With the containment chamber 12 in the deployed position, a fill plug 40 can be exposed. The fill plug 40 can be at least partially removed to provide access to the propellant container 24 within the propellant chamber 14. A propellant configured to deploy the bag disposed in the containment chamber 12 can be loaded into the propellant chamber 14 through an opening exposed by removing the fill plug 40. The propellant container 24 can include at least one visible fill line, and propellant can be added to the propellant container 24 until the fill line is reached. With a desired amount of propellant added to the propellant chamber 14, the fill plug 40 can be reattached, thereby sealing the propellant container 24 and allowing it to pressurize to a vapor pressure of the propellant contained therein. The propellant chamber 14 can optionally include a pressure gauge configured to allow display or other notification of a pressure of propellant contained within the propellant chamber 14 to help inform a user whether the propellant is at a safe and effective pressure. Propellant can be loaded into the propellant chamber 14 before and/or after the bag is loaded into the opening 28. Before the device 10 is turned on, e.g., by supplying a 5.5-30 Volt DC power source included in the electronics chamber 16 and placing a magnet over the device's hall effect switch, the propellant can be prevented from deploying the bag, and any other emergency mechanisms can also be prevented from deploying.

Figure 7:
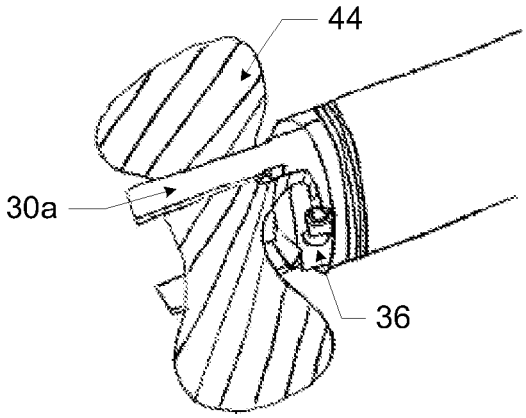
FIG. 7 is a perspective view of the containment chamber of FIG. 6 with the inflatable bag in a deployed position.

With the bag attached to the piston assembly 30 and propellant loaded into the propellant chamber 14, the piston assembly 30 can be reinserted into the cylindrical housing 32 by, e.g., distally pushing the piston assembly 30. The release plug 34 can also be reattached to the propellant chamber 14 using the screws 38, thereby securing the bag within the containment chamber 12 until it is deployed. The electronics chamber 16 can include a buzzer configured to signal a user that the bag contained in the containment chamber 12 has been properly configured and is ready for deployment upon appropriate trigger if it is not first deactivated by, e.g., manual intervention by a user. To help release at least a portion of the propellant from the propellant chamber 14 into the bag to deploy the bag by e.g., moving the containment chamber 12 from the undeployed position to the deployed position, the tube fitting 36 can be configured with a releasable mechanism, e.g., a valve, that can be triggered open upon appropriate actuation signal from the electronics chamber 16. Non-limiting examples of various ways to automatically inflate a bag using a propellant can be found in U.S. Pat. No. 4,482,333 issued Nov. 13, 1984 and titled "Automatic Inflation System," which is hereby incorporated by reference in its entirety. FIG. 7 shows the bag 44 in a deployed position following inflation of the bag 44 with a propellant delivered from the propellant chamber 14 to an internal cavity of the bag 44 through the tube fitting 36.

Referring again to FIGS. 1 and 2, the propellant chamber 14 can be in electronic communication (wireless and/or wired) with the electronics chamber 16, which can allow the electronics chamber 16 to trigger the propellant chamber 14 with a signal indicating when to "fire" or otherwise release a propellant disposed therein to deploy an emergency mechanism. Accordingly, a signal from the electronics chamber 16 can be effective as an actuator to deploy an emergency mechanism. The electronics chamber 16 can have a variety of configurations. In an exemplary embodiment, the electronics chamber 16 includes a processor such as a PIC microcontroller available from Microchip Technology Inc. of Chandler, Ariz., configured to process instructions related to, e.g., control of various aspects of the device 10 such as deployment of emergency mechanisms and communication with remote equipment at, e.g., at a land or boat-based control station. A microcontroller processes instructions in this embodiment, but any one or more processors configured to process instructions for a system, e.g., a central processing unit, a microprocessor, a digital signal processing unit, application specific integrated circuits ("ASIC"), a state machine, logic circuitry, etc., can be included in the device 10 to control various aspects of the device 10.

The electronics chamber 16 can be powered in any number of ways. The electronics chamber 16 can be externally powered by being in electronic communication with an underwater vehicle attached to the device 10, as discussed further below, and receive power from the underwater vehicle. Alternatively or in addition, the electronics chamber 16 can include an internal power source, e.g., a DC battery a providing a voltage in a range of about 5.5 to 30 volts. One or more lights, e.g., light emitting diodes, attached to an outside surface of the housing and/or disposed in and visible through the electronics chamber 16 or other portion of the device 10 can indicate an operating state of the device 10, such as the device's current power source, low power, deployment of an emergency mechanism, etc. The electronics chamber 16 can also include and/or control one or more display monitors disposed on or visible through the housing. The display monitor(s) can display past, present, and/or future operating characteristics of the device 10 and/or the underwater vehicle attached thereto. Any one or more operating characteristics can be displayed, such as an available amount of reserve power that can be provided by the device 10 and a depth of the device 10.

The electronics chamber 16 can also include at least one electronic emergency mechanism, although the electronics chamber 16 can additionally or alternatively include a physical emergency mechanism, as mentioned above. One example of an electronic emergency mechanism includes a sensor configured to detect an emergency event. The sensor can be configured to detect an emergency event by monitoring one or more conditions related to the device 10 and/or the underwater vehicle to which the device 10 is attached and to trigger an appropriate distress action upon detection of an emergency event, e.g., deploy an emergency mechanism, send a distress signal, etc. Alternatively or in addition, the sensor can be configured as a receiver to detect an emergency event by receiving a wired or wireless acoustic or other electronic signal from the underwater vehicle attached to the device 10 and/or from a remotely located control station indicating the occurrence of an emergency event, and the sensor can be configured to trigger an appropriate distress action in response. The device 10 can include one or more sensors, and each sensor can be configured to detect one or more emergency events indicating distress of the underwater vehicle attached to the device 10. Moreover, an underwater vehicle attached to the device 10 can include one or more sensors in addition or in alternative to sensor(s) in the device 10 and can be configured to be in electronic communication with the device 10 to trigger an appropriate distress action.

A person skilled in the art will appreciate that various types of sensors can be used. One example of sensor includes a power detector configured to detect a power loss in the underwater vehicle attached to the device 10. Upon detection of a power loss, the sensor can trigger activation of a reserve power supply included in the electronics chamber 16 configured to supply power to the underwater vehicle. Any reserve power supply, e.g., batteries, super capacitors, etc., configured to provide any amount of power, e.g., at least about fifteen Farads, etc., can be used, but the amount of reserve power carried by the device 10 is preferably at least an amount of power necessary to deploy the buoyancy mechanism in the containment chamber 12 and to run any signaling equipment configured to contact a remotely located control station. Another example of a sensor includes a depth or pressure sensor configured to measure depth of the device 10 and/or its attached underwater vehicle. The depth sensor can be configured to arm only after the underwater vehicle is under the water and/or can be configured to detect when the underwater vehicle is operating unsafely, e.g., diving too quickly, diving too deep, etc. Another example of a sensor includes a time sensor configured to detect when the underwater vehicle attached to the device 10 has been underwater for a time exceeding a predetermined threshold time programmed into the processor in the electronics chamber 16 that indicates a maximum safe operating time, such as a time after which the underwater vehicle should be retrieved to, e.g., ensure that the underwater vehicle has adequate power to resurface. Yet another example of a sensor includes a tilt sensor configured to detect if the device 10 is tilting head-first above a predetermined threshold angle programmed into the processor in the electronics chamber 16 that indicates a maximum safe operating angle. If the device 10 is slightly positively buoyant as indicated by meeting or exceeding the threshold angle, this can signify that the underwater vehicle attached to the device 10 is stopped and that the device 10 is floating up with its head end 22, connected to the underwater vehicle, pointed down. Still another example of a sensor includes a speed sensor configured to detect if a speed of the underwater vehicle attached to the device 10 has fallen below a predetermined threshold minimum speed, thereby indicating that the underwater vehicle is disabled, stuck, or otherwise in distress, and/or if the underwater vehicle's speed has exceeded a predetermined threshold maximum speed, thereby indicating an undesirable operating condition that could negatively impact functionality of the underwater vehicle. In addition, the sensor could be a timer—if the mission exceeds a preset maximum time limit a rescue could be indicated.

Another example of an electronic emergency mechanism includes a communications link, e.g., a radio link, a satellite link, an underwater acoustic transmitter link, etc., configured similar to a marine Emergency Position-Indicating Radio Beacon ("EPIRB"). The communications link can be configured to communicate a position of the device 10 to a remote location using a global positioning system ("GPS") or other positioning system. The communications link can be configured to transmit a position upon any trigger, such as by receiving a trigger signal from a sensor to communicate the device's and/or underwater vehicle's position upon the sensor's detection of an emergency event. The position communication can occur immediately upon receipt of a trigger signal or after a time delay, such as after the device 10 has buoyed to the water surface following deployment of an inflatable bag from the containment chamber 12. In some embodiments, the position communicated over the communications link can trigger a distress action if, e.g., the device 10 has strayed outside a preprogrammed area.

In addition or as an alternative to the communication link, the nose portion 18 of the device 10 can include a location identifying mechanism, such as an acoustic pinger 26 configured to send a long range acoustic signal through water, to signal a location of the device 10. In an exemplary embodiment the pinger 26 can continuously ping at defined intervals to signal the device's location once the device 10 has dived beyond a threshold depth and/or has been deployed for a threshold amount of deployed time. The pinger 26 can ping at any frequency or rate, e.g., at about 10 kHz.

The processor in the electronics chamber 16 can be preprogrammed before deployment of the device 10 underwater. As will be appreciated by a person skilled in the art, the processor can be programmed in any way, such as by using an RS-232 terminal, e.g., a stationary or laptop computer running Windows Hyperterm (HyperTerminal™ available from Microsoft Corp. of Redmond, Wash. or Hilgraeve, Inc. of Monroe, Mich.), to store one or more parameters in a memory mechanism configured to be accessible by the processor. Any type of memory can be used for the memory mechanism, including but not limited to one or more of volatile (e.g., SRAM, etc.), non-volatile (e.g., flash, hard drive, etc.), or other memory. A non-volatile memory can retain programmed parameters following device shut-off so that programmed parameters need not be re-entered if the device 10 is power cycled.

Various parameters can be preprogrammed into the processor. One exemplary programmable parameter includes an emergency mechanism deployment delay time that can indicate a time between detection of an emergency event and when an emergency mechanism such as inflation of a buoyancy mechanism or sending of a distress signal should be deployed in response to the detection. Using the emergency mechanism deployment delay time can serve as a safety feature to prevent premature deployment of an emergency mechanism if, for example, the underwater vehicle attached to the device 10 becomes stuck in mud but is able to dislodge itself under its own power. Another exemplary programmable parameter includes an armed depth, which can indicate a depth below which the device 10 will enable at least one and preferably all of its emergency mechanism rescue features. Having an armed depth above which emergency mechanisms will not be deployable can help eliminate erroneous implementation of the device's rescue features on the surface and can act as a safety interlock for users. Yet another exemplary programmable parameter includes a threshold depth above which the device 10 will automatically deploy at least one emergency mechanism because the device 10 has exceeded a maximum desirable depth. Another exemplary programmable parameter includes a power management feature to indicate which one or more features of the device 10 to deactivate or turn off during non-emergency operation of the device 10 in order to conserve power. Any one or more features of the device 10 can be "flagged" for non-emergency shut-off using the power management feature, such as the pinger 26, a driver or receiver interface between the processor and RS-232 terminal such as a MAX232 (available from Maxim Integrated Products of Sunnyvale, Calif.) or other integrated circuit, lights, display monitors, etc.

The rescue device 10 can be fixedly or removably attached in any way to an underwater vehicle. The underwater vehicle can be configured to attach to the device 10, or because the device 10 is modular, the device 10 can attach to an existing underwater vehicle without requiring much if any modification to the existing underwater vehicle. In some embodiments, the device 10 can fixedly or removably attach to an underwater vehicle with a cable or tow line extending between the head end 22 of the device 10 and a tail end of the underwater vehicle, which can allow the device 10 to be disposed outside the underwater vehicle and be towed behind the underwater vehicle when the underwater vehicle is in motion underwater, traditionally at a speed in a range of about one to four knots. In some embodiments, the device 10 can be fixedly or removably attached to an outside surface of an underwater vehicle using any one or more attachment mechanisms, e.g., bolts, clamps, screws, welding, etc., as will be appreciated by a person skilled in the art. The device 10 can be fully or partially disposed outside the underwater vehicle when attached to an outside surface thereto. Attaching the device 10 to an outside surface of the underwater vehicle can help reduce chances of the device 10 becoming accidentally detached from the underwater vehicle and/or the tow line extending between the device 10 and the underwater vehicle becoming tangled, severed, or otherwise disabled to diminish or eliminate effective operation of the device 10 and/or the underwater vehicle.

Figure 8:
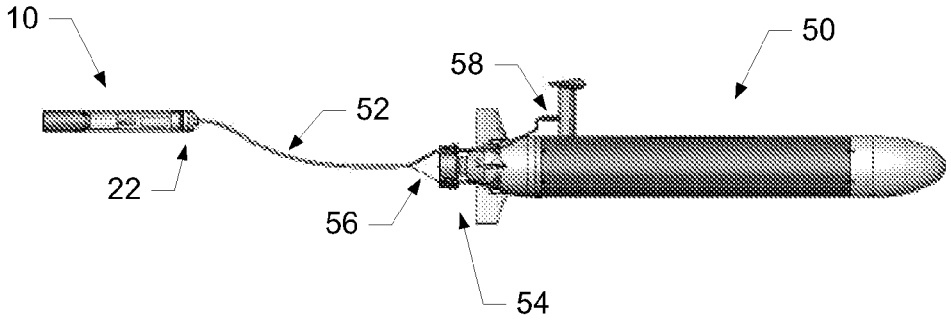
FIG. 8 is a side view of the rescue device of FIG. 1 attached with a cable to an autonomous underwater vehicle.
Figure 9:
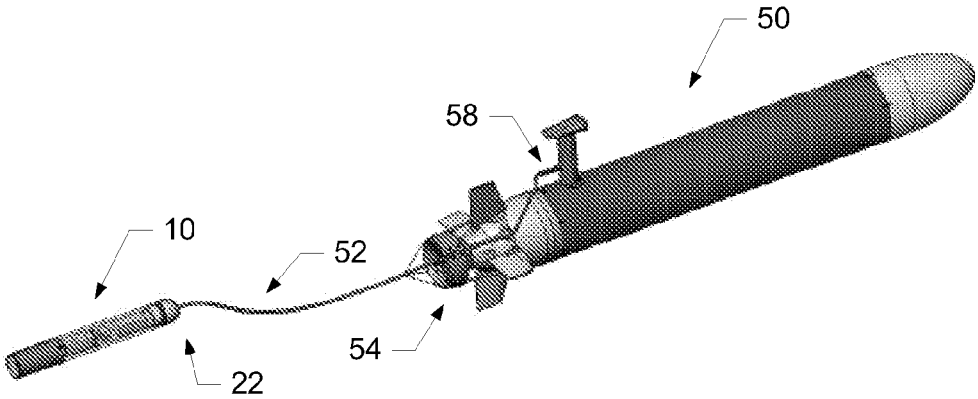
FIG. 9 is a perspective view of the attached rescue device and autonomous underwater vehicle of FIG. 8.
Figure 10:
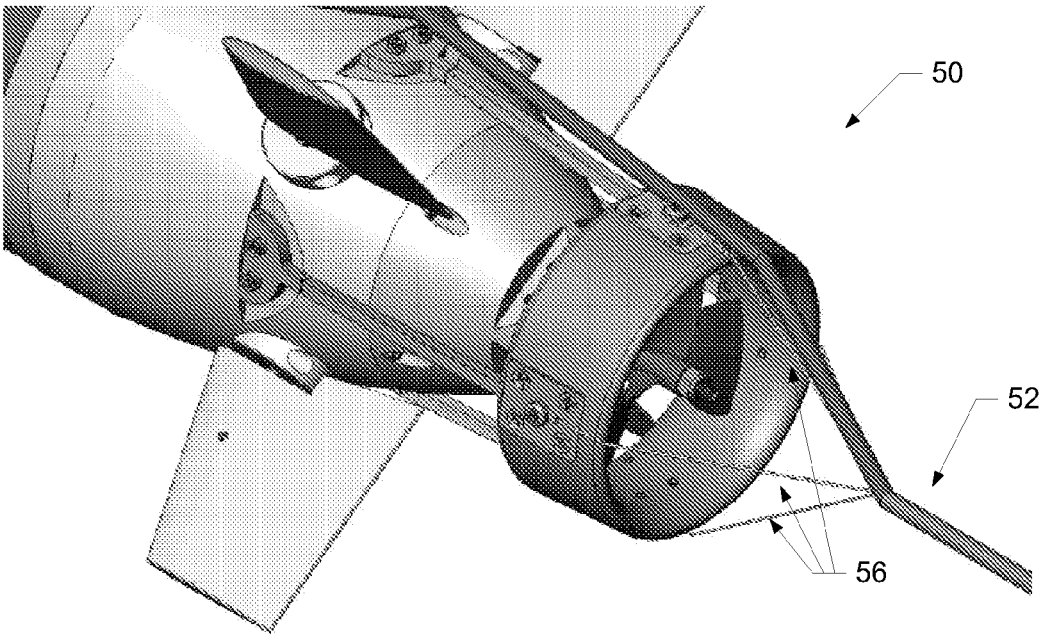
FIG. 10 is a perspective view of a mechanical connection between the autonomous underwater vehicle and the cable of FIG. 8.

In an exemplary embodiment of the rescue device 10 attached to an underwater vehicle illustrated in FIGS. 8-10, the device 10 can be attached to an AUV 50, e.g., a 42 pound Iver2 AUV available from OceanServer Technology, Inc. of Fall River, Mass., with a cable 52 extending between the head end 22 of the device 10 and a tail end 54 of the AUV 50. The cable 52 can have any size, shape, and configuration. In the illustrated embodiment, the cable 52 has a fixed length in a range of about 2 to 4 feet, but the cable 52 can have any fixed or variable length. For example, in another embodiment, a variable length cable extending between the device 10 and the AUV 50 can be at least partially spooled or coiled inside the body of the device 10 and/or the AUV 50. Non-limiting examples of a various reeling systems can be found in U.S. Pat. No. 3,961,589 issued Jun. 8, 1976 and titled "Buoyant Cable Antenna Reeling System," which is hereby incorporated by reference in its entirety. In this way, in the event of an emergency, the cable can act as a relatively long line that can be payed out from within the device 10 and/or the AUV 50 to allow the device 10 to rise to the water surface if the AUV 50 is unable to be released from a stuck position with increased buoyancy provided by the device 10, if the device 10 cannot properly deploy an emergency mechanism, or if any other problem is encountered in rescuing the AUV 50. Any length of cable can be spooled inside the device 10 and/or the AUV 50, e.g., about 600 feet, but it is preferably a length much longer than a length of unspooled cable extending between the device 10 and the AUV 50 to allow the device 10 to float a large distance away from the AUV 50 and reach a water surface when the cable 10 is at least partially unspooled.

The cable 52 can be attached to the device 10 and to the AUV 50 in any way, as will be appreciated by a person skilled in the art. As illustrated, the cable 52 includes a mechanical connection element 56 configured to mechanically couple the cable 52 to the AUV 50 at the AUV's tail end 54 using an attachment mechanism, e.g., bolts, screws (as shown), clamps, welding, etc. The mechanical connection element 56 can include a plurality of connection elements, as illustrated, to help support tension placed on the cable 52 by the device 10 when the AUV 50 is in motion and towing the device 10, although tension can be supported in any way appreciated by a person skilled in the art. The cable 52 can also include an electrical connection element 58 configured to electrically couple the cable 52 to the AUV 50 to allow electrical communication between the AUV 50 and the device 10 for powering purposes, for signaling between the device 10 and the AUV 50, etc. The electrical connection element 58 can include a waterproof electrical connector, such as an underwater pluggable connector available from Impulse Enterprise of San Diego, Calif. or a Subconn® Underwater Connector available from Subconn Inc. of Burwell, Nebr. Electrical communication between the device 10 and the AUV 50 can be achieved in any way appreciated by a person skilled in the art, such as via a wire or fiber included in the cable 52. The mechanical and electrical connection elements 56, 58 separately attach to the AUV 50, but a person skilled in the art will appreciate that they can connect to the AUV 50 in any way, including singularly.

A person of ordinary skill in the art will recognize that features illustrated or described in connection with one exemplary embodiment may be combined with the features of other embodiments. Such modifications and variations are intended to be included within the scope of the present invention. A person of ordinary skill in the art will also appreciate further features and advantages of the invention based on the above-described embodiments. For example, specific features from any of the embodiments described above may be incorporated into devices or methods of the invention in a variety of combinations and subcombinations, as well as features referred to in the claims below which may be implemented by means described herein. Accordingly, the invention is not to be limited by what has been particularly shown and described, except as indicated by the appended claims or those ultimately provided. Any publications and references cited herein are expressly incorporated herein by reference in their entirety.

The invention claimed is:

1. A rescue and recovery system, comprising:

an autonomous underwater vehicle; and a rescue device having:

a submersible housing coupled to and disposed outside the autonomous underwater vehicle;

an emergency mechanism located within the housing and configured to be deployed upon detection of an emergency condition;

an actuator configured to deploy the emergency mechanism; and a sensor configured to detect an emergency condition and to trigger the actuator to deploy the emergency mechanism upon detection of the emergency condition wherein the emergency condition includes at least one of exceeding a threshold dive time, falling below a threshold travel speed, the housing longitudinally oriented above a threshold angle, and exceeding a threshold dive speed;

wherein the rescue device is connected to and spaced apart from the autonomous underwater vehicle so that the rescue device is towed behind the autonomous underwater vehicle at a distance.

2. The system of claim 1, wherein the emergency mechanism includes at least one of a light, an expandable bag, a flare, a signal transmitter, a flag, a dye, and a GPS system.

3. The system of claim 1, further comprising a cable configured to couple the housing to the autonomous underwater vehicle.

4. The system of claim 3, wherein the cable connects to a head of the housing and a tail of the autonomous underwater vehicle to allow the housing to be towed underwater by the autonomous underwater vehicle.

5. The system of claim 3, wherein the cable is configured to have a first length extend between the housing and the autonomous underwater vehicle and a second length that is longer than the first length contained within at least one of the housing and the underwater vehicle.

6. The system of claim 5, wherein at least a portion of the cable is configured to unspool when underwater to increase a distance between the housing and the autonomous underwater vehicle.

7. The system of claim 1, wherein the housing is configured to decouple from the autonomous underwater vehicle upon detection of an emergency condition.

8. The system of claim 1, wherein the emergency mechanism includes a buoyancy mechanism, and wherein the actuator is configured to expand the buoyancy mechanism to increase a buoyancy of the housing and the autonomous underwater vehicle coupled to the housing.

9. The system of claim 1, wherein the actuator includes at least one of an R134a refrigerant, carbon dioxide, and an explosive powder.

10. The system of claim 1, wherein the sensor is located within the housing.

11. The system of claim 1, further comprising a power system located within the housing and configured to provide power to the housing independent of the autonomous underwater vehicle.

12. The system of claim 11, wherein the actuator is configured to turn on the power system upon detection of the emergency condition.

* * * * *